US006726060B1

(12) United States Patent
Ragusa et al.

(10) Patent No.: US 6,726,060 B1
(45) Date of Patent: Apr. 27, 2004

(54) THREADED CLOSURE FOR TUBE OPENING

(75) Inventors: Gerard Ragusa, Chicago, IL (US); Dennis A. Gross, Lake Forest, IL (US)

(73) Assignee: Barristo Enterprises, Inc., Chicago, IL (US)

( * ) Notice: Subject to any disclaimer, the term of this patent is extended or adjusted under 35 U.S.C. 154(b) by 0 days.

(21) Appl. No.: 10/376,859

(22) Filed: Feb. 28, 2003

(51) Int. Cl.[7] ..... B67D 5/00
(52) U.S. Cl. ..... 222/83; 222/91
(58) Field of Search ..... 222/83, 91

(56) References Cited

U.S. PATENT DOCUMENTS 2,873,886 A * 2/1959 Miskel et al. ..... 222/91
5,156,303 A * 10/1992 Yamamoto et al. ..... 222/568
5,501,370 A * 3/1996 Okamura et al. ..... 222/111
5,799,829 A * 9/1998 Lier et al. ..... 222/83
6,293,431 B1 * 9/2001 Seymour et al. ..... 222/83
6,315,165 B1 * 11/2001 Regan ..... 222/103

* cited by examiner

*Primary Examiner*—Philippe Derakshani
(74) *Attorney, Agent, or Firm*—Dennis A. Gross; The Hill Firm

(57) ABSTRACT

A tube having a needle piercing membrane closing the threaded opening of a tube neck is provided with a screw-on nozzle defining cap having an internal stopper projecting into the mouth opening to the throat, the stopper sealingly engaging the perforated mouth opening and terminating adjacent the membrane.

7 Claims, 1 Drawing Sheet

THREADED CLOSURE FOR TUBE OPENING

BACKGROUND OF THE INVENTION

1. Field of the Invention

This invention relates to containers and more particularly to a sealed dispensing tube having a membrane pierced by a needle which passes through the lumen of a nozzle cap threaded to the tube.

2. Prior Art

Product dispensing tubes having a neck with a mouth opening, or a throat, closed by a membrane are well known and are commonly employed, for example, in adhesive containers where, by sealing the container with the membrane, increases in the shelf life of the product is attained. The membrane must be pierced in order to dispense the contents of the container and such piercing is often accomplished by pin or needle-like structures affixed to the cap.

It has been known to have threaded caps on such containers which are equipped either with membrane piercing pins (or needles) on the outside of the cap such that upon unthreading the cap from the container, and inverting the cap, the membrane piercing pin can be pushed through the membrane, or in other instances, the pin is formed on the interior of the cap and a spacer structure is interposed between the container and the cap to prevent the cap from being tightened down sufficiently on the container to pierce the membrane. Upon removal of the cap, the spacer can be discarded, and thereafter by retightening the cap fully on the container, the pin can pierce the membrane. Distinct disadvantages of such cap piercing systems exist. In the first type, the pierced opening is never reclosed and the contents of the container can flow through the pierced membrane unobstructed even when the cap is threaded back onto the container. Although in the second type of structure, the piercing pin will reenter the pierced opening each time the pin is screwed back on, thereby substantially closing the pierced opening, product leakage still can occur around the piercing pin particularly as the opening enlarges after repeated recapping, and then follow the threads of the cap to provide a leakage path to the exterior.

Recently a two-piece cap container has been described having a nozzle defining cap which is permanently affixed to the tube container and extends from the mouth of the container. The cap has a nozzle lumen open to the mouth downstream of the membrane. An overcap which can be threaded to the nozzle cap is provided with an axially movable pin which passes through the lumen of the nozzle when the caps are joined together and which is moveable from a position spaced from the membrane to a position piercing the membrane.

After piercing the membrane, the outer cap can be unthreaded from the nozzle cap thus withdrawing pin from the lumen and allowing the contents of the container to be dispensed through the pierced membrane and through the nozzle. On completion of dispensing, the outer cap can again be threaded onto the nozzle cap with the pin in the nozzle lumen and projecting into the membrane opening. In this type of structure, shown, for example, in U.S. Pat. No. 5,799,829, the teachings of which are incorporated herein by reference, after each use the pierced membrane opening will be reclosed, substantially, by the pin, thus reducing leakage. However, because the nozzle cap is permanently fixed to the tube, usually by being snapped onto the tube, a large open space is provided between the membrane and the tip of the nozzle which can be filled with product which can then leak out between the nozzle cap and the tube neck. This leakage path can vary due to tolerance differences between the normally molded plastic nozzle cap and the container neck, normally made of metal. Because the nozzle cap is fixed to the container, it is not possible to tighten the connection between the container and cap to eliminate leakage paths.

It would therefore be an advance in the art to provide an improved membrane sealed dispensing container utilizing a nozzle cap attached to the container and a pin carrying overcap threaded to the nozzle cap with an acutalable pin to pierce the membrane where leakage paths between the nozzle cap's exterior and tube interior are blocked.

SUMMARY OF THE INVENTION

This invention overcomes the disadvantages of the prior art by providing a threaded tube neck having external threads engaging internal threads in a counter bore of a nozzle cap allowing the nozzle cap to be tightened down on the container neck to eliminate leakage paths due to thread engagement. The nozzle cap is provided with an interior stopper which surrounds a lumen of a dispensing nozzle of the nozzle cap and which projects into the interior of the tube throat through the mouth opening while engaging the inner diameter of the throat at the mouth opening to provide a seal. The stopper terminates in closely spaced relation to the membrane. By tightening the nozzle cap onto the threaded neck of the container until the stopper has engaged and sealed against the throat opening at the mouth, leakage paths between the container interior and the exterior at the container neck are eliminated and the lumen is closed except to the mouth of the tube.

In an embodiment of the invention, a dispensing container formed as a metal tube is provided with a tube neck projecting therefrom terminating in a mouth open to a throat opening. The throat opening is closed by a membrane spaced from the mouth opening and a nozzle cap, formed of plastic is provided with a counter bore at an end thereof having internal threads adapted to mate with external threads of the tube neck, the counter bore terminating at an internal stopper dimensioned to plug the mouth opening when the nozzle cap is threaded onto the tube neck, the stopper having an axial opening therethrough to the lumen of the nozzle. An overcap is threadably connected to the nozzle cap and has an interior bore adapted to sealingly engage the exterior of the nozzle adjacent a dispense end of the nozzle. The overcap carries an actuatable axially movable pin which projects through the lumen of the nozzle and which when depressed pierces the membrane and plugs the dispense opening to the interior of the lumen.

It is therefore an object of this invention to provide an improved membrane sealed container having a dispensing nozzle cap carried at a throat of the container with a pin carrying outercap having an actuatable pin for piercing the membrane with an internal stopper on the nozzle cap plugging the mouth opening of the container.

It is another object of this invention to provide a dispensing container particularly adapted to dispense liquid adhesives employing a metal tube having a neck with a throat blocked by a pierceable membrane closing the throat at a point spaced from a mouth opening to the throat at an end of the neck, the tube being provided with a threadably connected nozzle cap having a lumen extending therethrough open to the interior of the throat, a lumen opening being defined in a stopper formed in the nozzle cap interior which projects into the mouth of the container and seals the mouth except through the lumen.

DESCRIPTION OF THE DRAWINGS

The FIGURE is a sectional view of the end portions a container equipped with the threaded-on nozzle cap and pin carrying overcap.

DESCRIPTION OF THE PREFERRED EMBODIMENT

Figure 1:
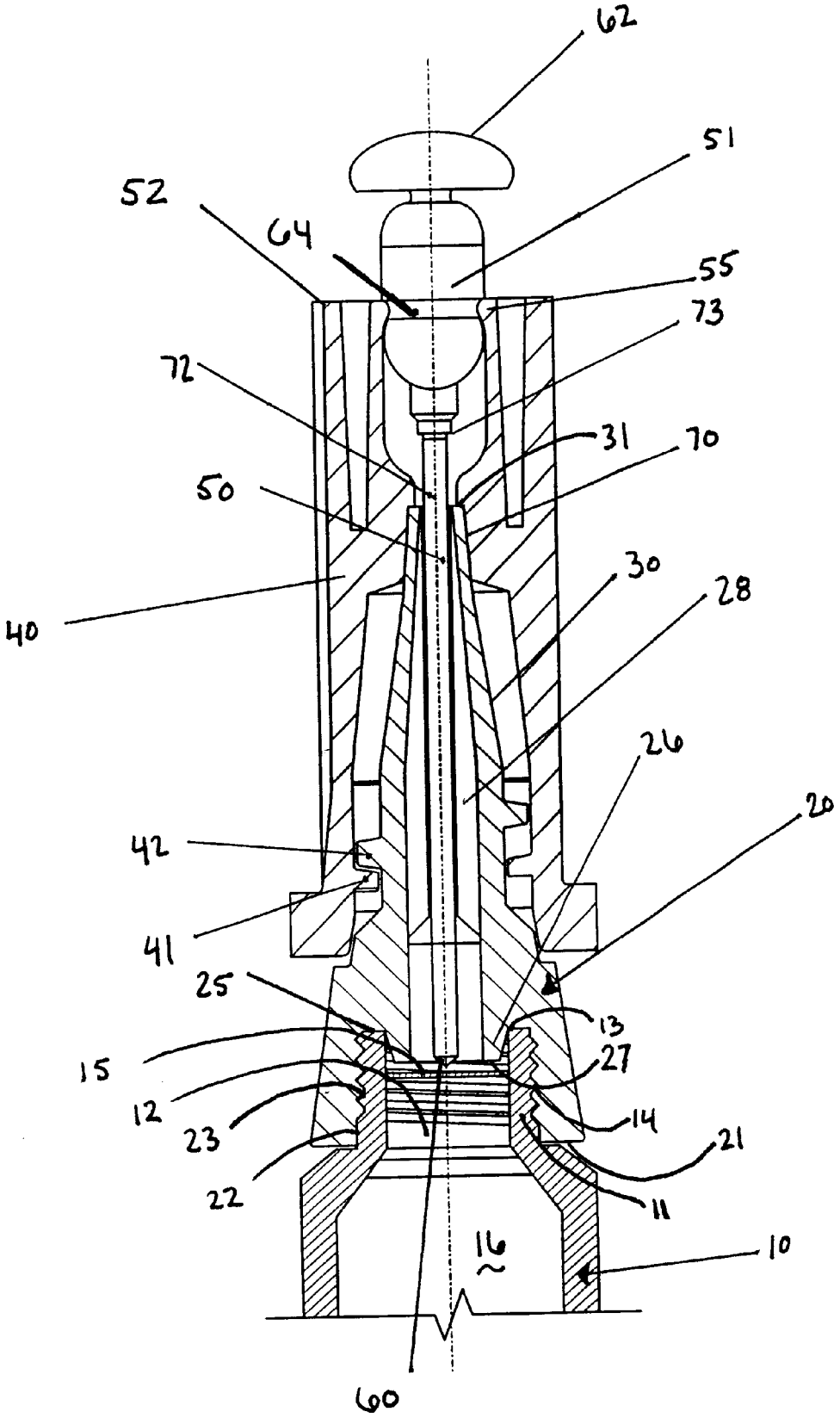

As shown in the FIGURE a container 10, preferably formed as a metal tube has a neck 11 projecting therefrom, the neck defining a throat opening 12 terminating in a mouth 13. The neck is externally threaded as at 14. Intermediate the ends of the neck 11, an internal membrane 15, preferably formed of metal, closes the interior 16 of the tube. The membrane 15 is spaced from the mouth 13.

A first cap 20 has an end 21 open to a counter bore 22 provided with internal threads 23, the threads 23 matching the threads 14 of the neck 11. The counter bore terminates in a bottom 25 from which projects a stopper 26 terminating in an annulus end 27 surrounding the opening to a lumen 28 of the cap 20. The stopper 26 may be tapered at its outer diameter and is dimensioned to be received into the mouth 13 of the throat with the end 27 spaced closely from the membrane 15 when the cap is fully tightened down on the neck. The stopper has a major diameter such that as the cap 20 is threaded down onto the neck, the stopper will engage the inner diameter of the mouth 13 to plug the throat except through the lumen 28. Thus, neither the contents of the lumen of the container have an unstoppered pathway to the neck OD-counter bore ID area.

As will be appreciated by persons of ordinary skill in the art, the thread connection may be dimensioned with respect to the stopper such that the stopper will engage the inner diameter of the mouth prior to the time when the threads are fully seated together so that further tightening of the cap onto the tube will increase the seal between the outer surface of the stopper and the inner diameter of the mouth while at the same time tightening the threads in a tensioned engagement. This provides a dual seal, first a seal between the stopper and the mouth and secondly a seal along the threads.

The cap 20 terminates in a nozzle 30 having an open end 31. An overcap 40 is threadably engagable with the cap 20 by mating quick threads 41 and 42. The overcap carries a piercing pin 50 having a head 51 projecting beyond the end 52 of the overcap. The pin 50 is preferably dimensioned such that with the end 51 in its most extended position, and retained therein by a bead 55 of the overcap received in a groove 64 of the head 51, the piercing tip 60 of the pin 50 will be spaced from the membrane 15. Thereafter pressing against the end face 62 of the head 51 will expand the bead 55 to allow the pin to be pressed through the membrane, piercing it. The overcap has a tapered interior opening as at 70 which, when the overcap is threaded onto the cap 20 engages the outer diameter of the nozzle 30 providing a seal between the outer diameter of the nozzle and the tapered opening 70. The pin 50 preferably has an increased diameter section 72 which, when the pin is pressed downwardly into its membrane piercing position, will plug the open end 31 of the nozzle 30 and expand it against the tapered opening 70. It will be appreciated that by properly dimensioning the increased diameter section 72 with respect to the tapered opening 70, the nozzle opening will be completely sealed when the overcap is tightened onto the nozzle cap with the pin in its membrane piercing position.

Although the increased diameter section 72 can be provided at, for example, a step or conical juncture 73 between the pin 50 and the end 51, preferably the pin has an axial length of gradually increasing diameter to provide a wedge effect as the overcap is threaded onto the nozzle cap with the pin in the lumen of the nozzle. This eliminates criticality of full tightening of the overcap into seated relationship with the nozzle cap since a full blockage of the lumen can be obtained before the tube caps have reached their full extent of possible tightening.

It can therefore be seen from the above description that this invention provides an improved seal preventing accidental leakage of the contents of the tube from the interface between the nozzle cap 20 and the tube neck. This leakage is prevented first by reason of the threaded connection which permits the cap to be tightened onto the neck to provide full surface engagement between the threads. By making the tube neck of metal and the nozzle cap of plastic having a resiliency or compressibility, the provision of a good thread-to-thread seal can be obtained. Secondly, the use of the stopper 26 projecting into and sealing the throat opening at the mouth blocks liquid flow from the container to the neck exterior. In a preferred embodiment these tubes will be used with cyanoacrolyte adhesives where the provision of a good seal between the container interior and the environment after opening of the container provides extended periods of reusability.

Although we have shown our invention in connection with the preferred embodiment, it will be appreciated by those of ordinary skill in the art that many variations on this invention can be made. For example, although I have described the membrane as being formed as a part of the container, it could be a separate structure. For example, a thimble-like overcap could be provided pushed into the end of the throat at the mouth forming a cup with a closure membrane at the bottom of the cup. In such a structure the stopper would engage the inner diameter of the cup adjacent cup lip. Additionally, although I have described the preferred embodiment of being a metal container and a plastic cap, the material could be reversed or both could be made of plastic.

We claim:

1. A dispensing container for cyanoacrolyte comprising a metal tube having an externally threaded neck at one end of the tube, the neck defining a throat opening, a membrane closing the throat opening, the membrane spaced axially of a tube mouth, a dispensing cap having an axially extending nozzle with a lumen therethrough, the lumen open to the end of a counter bore at one end of the cap opposite a nozzle tip, the counter bore having internal threads mating with the external threads of the neck to removably attach the dispensing cap to the tube, an overcap threadably connectable to the nozzle cap and removable therefrom, the overcap carrying a movable pin extendable through the lumen into juxtaposition with the membrane when the dispensing cap is fully threaded on the neck and the overcap is fully threaded on the dispensing cap, the pin moveable to pierce the membrane.

2. A container according to claim 1 wherein the counter bore terminates interiorly in an axially projecting stopper which extends into the mouth of the tube when the dispensing nozzle cap is threaded onto the tube neck, the stopper engaging and sealing against the throat, the lumen extending through the stopper.

3. A container according to claim 1 wherein the tube and neck are made of metal and the nozzle cap is made of plastic.

4. A container comprising a tube, said tube including a membrane-sealed mouth and a dispensing nozzle threadably connected to the mouth and a closure cap threadably connected to the dispensing nozzle, the closure cap carrying a membrane piercing pin guided in a bore of the nozzle and movable between a non-membrane piercing position and a membrane piercing position, a stopper extending into the mouth and sealingly engaging an inner diameter surface of the mouth, the stopper having a bore communicating with the nozzle bore whereby the interior of the container is sealed from an area of threaded connection of the nozzle, to the tube and neck after the membrane is pierced.

5. A dispensing tube, particularly adapted for use with cyanoacrolyte adhesives comprising a metal tube having a projecting neck terminating in a mouth, a sealing membrane closing the neck at a point spaced from the mouth, a cap threaded onto the neck having a nozzle projecting away from the container, the nozzle having a lumen therethrough, the lumen open to the throat, the threads of the cap and tube engaging one another to substantially block any leakage path along the threads.

6. A container according to claim 5 wherein the cap has a counter bore in its threaded end, the counter bore being internally threaded, the counter bore terminating in a blind bottom wall, the bottom wall having a central axially projecting stopper member projecting towards an open end of the counter bore, the stopper dimensioned to plug the mouth of the neck at a point spaced from the membrane, the lumen open through the stopper.

7. A container according to claim 6 including an overcap threadably connected to the cap, the overcap carrying a movable pin movable between a storage position and a membrane piercing position with the pin transiting the lumen.

* * * * *